United States Patent [19]

Kaplan et al.

[11] Patent Number: 4,902,079

[45] Date of Patent: Feb. 20, 1990

[54] WALL OR DESK MOUNTED DATA COLLECTION TERMINAL

[75] Inventors: Jay A. Kaplan, Wayland; Peter Place, Ashland, both of Mass.

[73] Assignee: Bull HN Information Systems Inc., Billerica, Mass.

[21] Appl. No.: 823,919

[22] Filed: Jan. 30, 1986

Related U.S. Application Data

[63] Continuation of Ser. No. 538,049, Sep. 30, 1983, abandoned.

[51] Int. Cl.[4] ..... A47B 67/02

[52] U.S. Cl. ..... 312/245; 248/349; 248/126

[58] Field of Search ..... 312/107, 107.5, 7.2, 312/7.1, 245, 196, 208, 240, 242, 308, 293; 165/137; 108/50.1; 248/126, 176, 349; 211/2, 88

[56] References Cited

U.S. PATENT DOCUMENTS

| | | | |
|---|---|---|---|
| 2,540,296 | 2/1951 | Schwend et al. | 312/208 X |
| 3,085,839 | 4/1963 | Gallagher | 312/240 X |
| 3,131,010 | 4/1964 | Erath | 312/240 X |
| 3,159,436 | 12/1964 | Davis | 312/107 |
| 3,595,513 | 7/1971 | Rehlaender | 108/1 X |
| 3,827,775 | 8/1974 | Arrogante | 312/245 |
| 3,954,244 | 5/1976 | Gopstein | 248/349 |
| 4,017,129 | 4/1977 | Boldt et al. | 312/7.2 |
| 4,403,700 | 9/1983 | Manlove | 312/245 X |

FOREIGN PATENT DOCUMENTS

| | | | |
|---|---|---|---|
| 458969 | 3/1951 | Italy | 312/7.1 |
| 766675 | 1/1957 | United Kingdom | 312/7.2 |

OTHER PUBLICATIONS

Sierra Information Systems Corporation (Siscor), ST-2000 Data Collection Terminal, pp. 1 and 2.

Burroughs Corporation, MT 1500 Data Terminal, 12/1980, pp. 1 and 2.

Hewlett Packard, Bar Code Reader Options for HP 3075A and 3076A Terminals, 10/1981, pp. 1–4.

Hewlett Packard, "HP 3075A, 3076A, 3077A Data Capture Terminals", 12/1978, pp. 1–8.

IBM, "3630 Product Overview", 11/1979, 1 page.

*Primary Examiner*—Joseph Falk

*Attorney, Agent, or Firm*—George Grayson; John S. Solakian; Gerald J. Cechony

[57] ABSTRACT

A data entry terminal includes a front panel, a shroud and a base plate. The terminal may be assembled as a desk mounted unit or a wall mounted unit, depending upon the orientation of the front panel to the shroud and base plate.

2 Claims, 6 Drawing Sheets

WALL MOUNTED FACTORY DATA COLLECTION TERMINAL

DESK MOUNTED FACTORY DATA COLLECTION TERMINAL

WALL OR DESK MOUNTED DATA COLLECTION TERMINAL

This application is a continuation, of application Ser. No. 06/538,049, filed 9/30/83, now abandoned.

RELATED APPLICATION

The following U.S. patent application filed on an even date with the instant application and assigned to the same assignee as the instant application is related to the instant application and is incorporated herein by reference.

"A Data Collection Terminal Designed for a Hostile Environment" by Carl C. Eckel and Jay A. Kaplan, having U.S. Ser. No. 538,048 and filed on Sept. 30, 1983, now abandoned.

BACKGROUND OF THE INVENTION

1. Field of the Invention

This invention relates to a data collection terminal for use in a hostile environment such as on a factory floor, a warehouse or a hospital, and more particularly to a common design wherein the same hardware may be assembled as a desk mounted or wall mounted terminal.

2. Description of the Prior Art

Many of the factories and warehouses have what is commonly called a hostile environment. Very often it is a dusty, oily environment and the floors may vibrate as lift trucks pass by or heavy machine tools are operating. However, there is a need to collect information from the factory or warehouse floor. This information may include additions or subtractions from inventory, parts in process status, machine-operator production, rejected parts, etc. To this end a number of systems have been developed wherein terminals placed on the factory floor are wired to a central computing system. Operators with greasy hands may operate the terminal by one or a combination of the following: placing their badge into a badge reader, using a hand-held wand to scan encoded data, or keying in the required information.

The data collection problem has been solved by a number of manufacturers. IBM in their 3630 Plant Communication System includes a 3641 reporting terminal, a 3643 keyboard display and a 3646 scanner control unit including a magnetic slot reader and a magnetic hand scanner.

Burroughs Corporation provides the MT 1500 which is "a free-standing microprocessor-based system, designed to be used as a worker-operated manufacturing-/distribution terminal in the warehouse, on the factory floor, and in other rugged, production oriented environments."

Sierra Information Systems Corporation provides the Sierra shop terminal ST-2000 which is "a multiple function shop terminal designed for customer application in hostile environments". The ST-2000 can be wall or table mounted.

Hewlett Packard provides the 3075A, 3076A and 3077A Data Capture Terminals. The desk mounted 3076A may be converted to the wall mounted 3075A by reversing the keyboard assembly. This results in the wall mounted terminal having all peripheral devices including the display in a different location from an operator's standpoint than the desk mounted terminal.

OBJECTS OF THE INVENTION

It is an object of the invention to provide an improved Data Collection Terminal.

It is another object of the invention to provide a Data Collection Terminal which is readily assembled as either a desk mounted or wall mounted terminal.

It is yet another object of the invention to provide a Data Collection Terminal which is readily converted from a wall mounted to a desk mounted terminal.

It is still another object of the invention to provide a Data Collection Terminal which is readily converted from a desk mounted to a wall mounted terminal.

It is also another object of the invention to provide a Data Collection Terminal which requires fewer spare assemblies to be stocked for manufacturing and field service requirements.

SUMMARY OF THE INVENTION

A data entry terminal includes a front panel, a shroud and a base plate The terminal may be assembled as a desk mounted unit or a wall mounted unit, depending upon the configuration of the front panel to the shroud and base plate.

If the front panel is in one orientation for one configuration, it is rotated 180 degrees for the other configuration.

BRIEF DESCRIPTION OF THE DRAWINGS

The novel features which are characteristic of the invention are set forth with particularity in the appended claims. The invention itself, however, both as to organization and operation may best be understood by reference to the following description in conjunction with the drawings in which:

DESCRIPTION OF THE PREFERRED EMBODIMENT

Figure 1A:
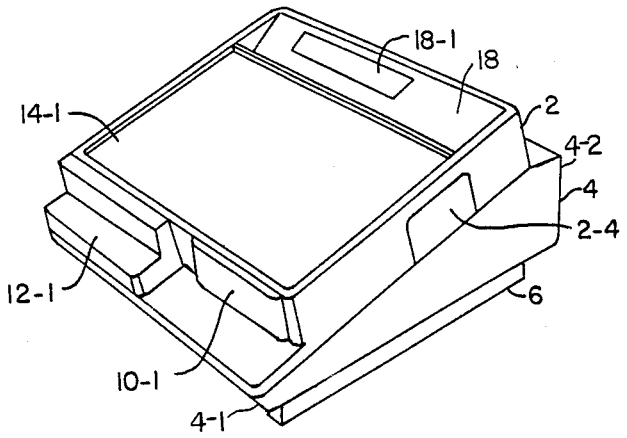
FIGS. 1A and 1B show the external features of the desk mounted terminal without and with accessories.
Figure 1B:
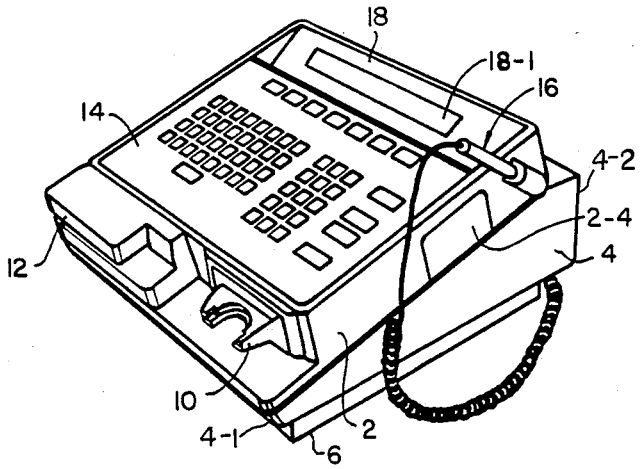

FIG. 1A shows the desk mounted factory data collection terminal without the accessories and FIG. 1B shows the desk mounted factory data collection terminal with accessories including a badge reader 10, a swipe reader 12, a keyboard 14, a display panel 18 and a wand reader 16. FIGS. 1A and 1B also show a front panel 2, a shroud 4 and a base plate 6.

Figure 2A:
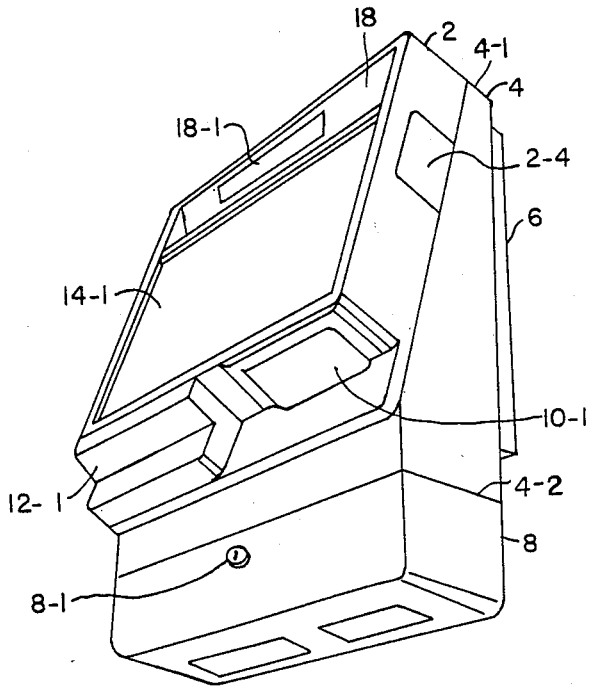
FIGS. 2A and 2B show the external features of the wall mounted terminal without and with accessories.
Figure 2B:
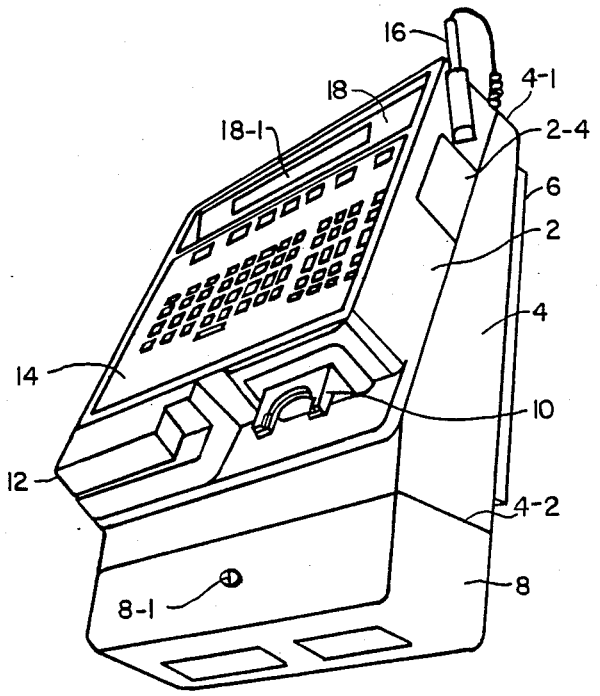

FIG. 2A shows the wall mounted factory data collection terminal without the accessories and FIG. 2B shows the wall mounted factory data collection terminal with accessories including badge reader 10, swipe reader 12, keyboard 14, wand reader 16 and display panel 18.

With the exception of a security conduit cover 8, a security keylock 8-1, and a wall bracket 8-2, both the desk mounted and wall mounted factory data collection terminals have the same elements. The one difference, assuming the same accessories, is that the front panel 2 is positioned 180° relative to a bottom piece made up of the base plate 6 and the shroud 4 for the desk mounted terminal as compared with the wall mounted terminal. That is, for the wall mounted unit the shroud 4 is mounted with the small thickness dimension side 4-1 at the top and the large thickness dimension side 4-2 at the bottom as in FIGS. 2A and 2B. For the desk mounted terminal unit, the shroud 4 is mounted with the small thickness dimension side 4-1 to the front and the large thickness dimension side 4-2 to the rear as in FIGS. 1A and 1B.

The desk mounted terminal of FIG. 1A and the wall mounted terminal of FIG. 2A have a cover 10-1 if the terminal does not have the badge reader 10, a cover 12-1 if the terminal does not have a swipe reader 12 and an optional wand 16. The terminal design allows several display options 18-2, shown in FIG. 3, including a clock display and single and multi-line alphanumeric displays. A cover 2-4 seals an opening in the front panel 2 and provides a space for the installation of a multi-function card reader (not shown). The desk mounted or wall mounted terminal may have a graphics panel 14-1 in place of the keyboard 14 if user keyboard entry is not required.

The covers 2-4, 10-1, and 12-1, display label 18-1, and keyboard 14 or graphics panel 14-1 keep dust from inside of the terminal by providing a seal against the front panel 2.

Figure 3:
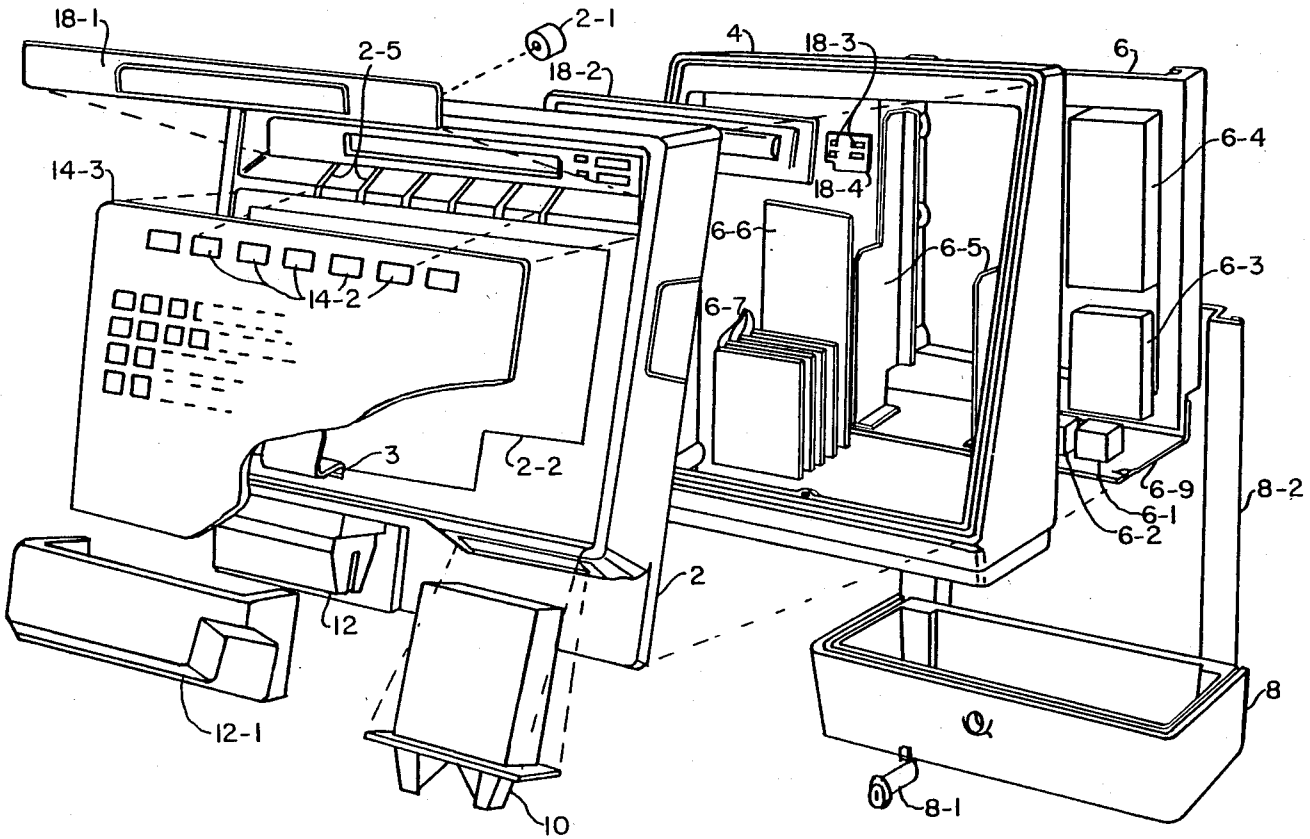
FIG. 3 breaks out the detail components of the wall mounted terminal.
Figure 4:
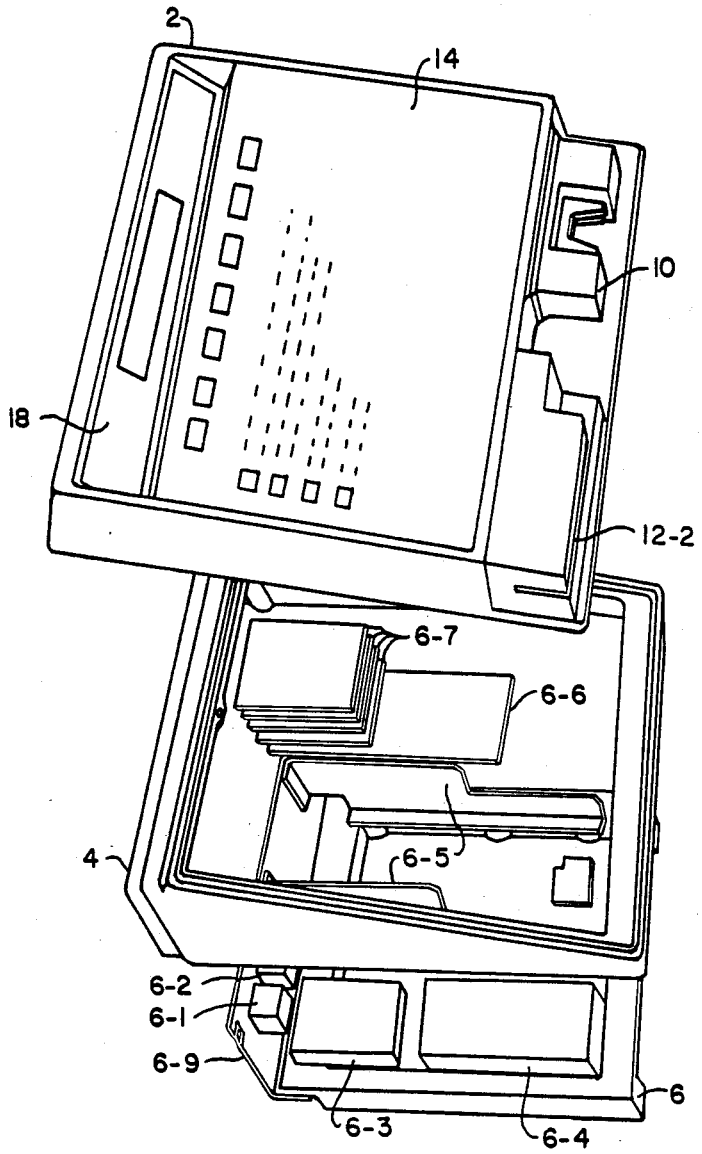
FIG. 4 breaks out enough of the detail components of the desk mounted terminal to show the relative position of the front panel 2 with respect to the base plate 6 for comparison with the orientation of FIG. 3.

FIG. 3 shows further detail of the wall mounted terminal and FIG. 4 shows further detail of the desk mounted terminal Mounted to the base plate 6 is a power supply 6-4 which provides direct current power to the terminal and a fan 6-3 which circulates the air within the terminal thereby preventing hot spots. Since the terminal is usually in a hostile environment, the terminal is sealed. No new air is brought into the terminal. The existing air is recirculated and the heat is dissipated through the aluminum base plate 6.

A panel 6-9 is mounted at right angles to the base plate 6 and has mounted to it a circuit breaker 6-1 which protects the terminal when the AC line current exceeds the current limits of the circuit breaker 6-1. Also mounted to the panel 6-9 is a line filter 6-2 which prevents voltage spikes from being imposed on the power supply 6-4.

Also mounted to panel 6-9 are brackets 6-5 into which are mounted a mother board 6-6 which controls the basic logic of the terminal and up to four daughter boards 6-7. Each daughter board 6-7 controls an accessory and is electrically coupled to the mother board 6-6.

A display label 18-1, FIG. 3, acts as a filter to enhance a display 18-2 and indicator lights 18-3 mounted on a printed circuit board 18-4. The display label 18-1 also seals off the opening in front panel 2 to prevent damage to the terminal from liquid or other contaminants.

Six depressions 2-5 in the front panel 2 line up functions displayed on the display 18-2 with 5 function keys 14-2 on keyboard 14. This enables information on display 18-2 to define for the operator the function that the terminal will perform when a particular function key 14-2 is depressed.

The keyboard 14 which fits within a depression in front panel 2 has a gasket 14-3, typically neoprene which again seal the inside of the terminal from liquid or other contaminants. The keyboard 14 provides keys using a membrane-type technology.

The swipe reader 12 may be a bar code reader or a magnetic card reader. The operator places a card in the slot and "swipes" the card past a read head in the swipe reader 12.

The operator places an identifying badge in the badge reader 10. The badge reader 10 may read holes in the badge.

The badge and card openings in the badge reader 10 and the swipe reader 12 face downward to minimize the possibility of contaminants from entering the readers, thereby reducing the number of service calls.

If the terminal does not include a badge reader, then a cover 10-1, FIGS. 1A and 2A, seals the badge reader 10 opening. Similarly, a cover 12-1 seals the opening if the terminal does not include a swipe reader.

An alarm 2-1 is mounted on front panel 2 to alert the operator of an error condition.

A printed circuit board 2-2 which defines the personality of the terminal provides the logic that communicates with all of the peripheral devices installed in the terminal.

The terminal may be designed to perform a specific function such as to record time and attendance or as a labor reporting terminal. For the time and attendance terminal, display 18-2 would be a clock display and show the time of day. For the labor reporting terminal, the display 18-2 is either a one row by forty character or a two row by forty character display.

Figure 6:
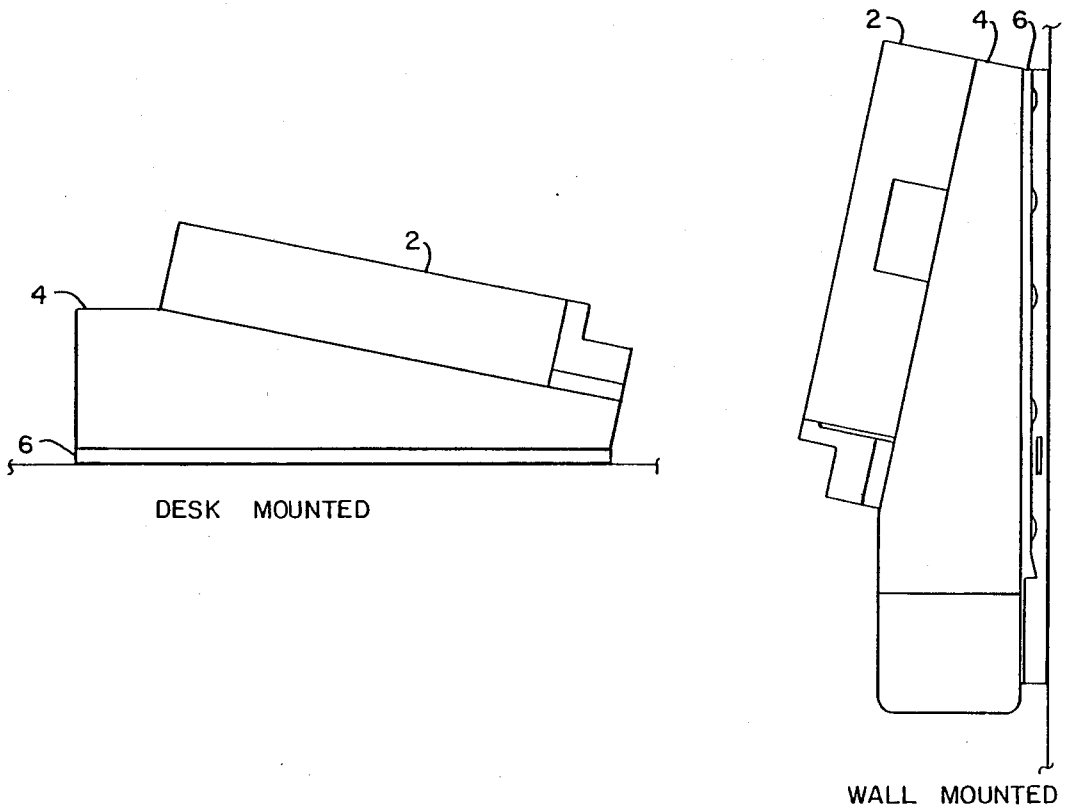
FIG. 6 shows an outline drawing of the orientation of the elements of the desk and wall mounted terminals.

Note that the front panel 2 of the desk mounted terminal of FIG. 4 is shown in FIG. 3 displayed 180 degrees with respect to shroud 4 and base plate 6. This is shown in FIG. 6. Assuming the same orientation of shroud 4 and base plate 6, front panel 2 is rotated 180 degrees to convert from a desk mounted to a wall mounted terminal or to convert from a wall mounted to a desk mounted terminal.

Figure 5:
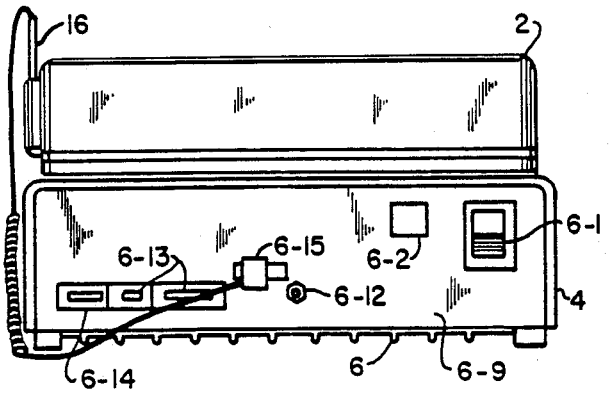
FIG. 5 shows a rear view of the desk mounted terminal.

FIG. 5 shows a back view of the desk mounted terminal. The panel 6-9 has mounted on it a combination circuit breaker/power-on switch 6-1, a line filter with AC receptacle 6-2 for connecting an external power cable, a receptacle for the wand reader signal cable plug 6-15, a coaxial cable connector 6-12, connectors 6-13 to provide auxiliary communications and relay ports on the mother board, and a binary switch 6-14 which assigns a terminal identification code to the terminal.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A data entry terminal for wall mounting or desk mounting which comprises:

base plate means for mounting a first plurality of electronic circuit components;

shroud means coupled to said base plate means having a first side and a second side wherein said first side has a small thickness dimension and said second side has a large thickness dimension, said first side being opposite to said second side; and front panel means fastened to said shroud means and having a plurality of openings for mounting input/output equipment, wherein said front panel means is mounted to said shroud means in a first orientation with said first side to the front of said terminal to facilitate access to said input/output equipment for said desk mounting and mounted in a second orientation with said first side to the top of said terminal to facilitate access to said input/output equipment for said wall mounting.

2. The terminal of claim 1 wherein said first orientation is rotated 180 degrees from said second orientation.

* * * * *